United States Patent [19]

Osborne

[11] Patent Number: 5,000,335

[45] Date of Patent: Mar. 19, 1991

[54] CYLINDRICAL STORAGE TANK WITH VAPOR PURGING MEANS

[76] Inventor: Keith J. Osborne, 22 W. 207 Second St., Glen Ellyn, Ill. 60137

[21] Appl. No.: 179,418

[22] Filed: Apr. 8, 1988

[51] Int. Cl.[5] ..... B65D 90/34

[52] U.S. Cl. ..... 220/85 F; 220/86.1; 73/49

[58] Field of Search ..... 73/40, 27, 49.2 T; 220/86 R, 85 F

[56] References Cited

U.S. PATENT DOCUMENTS

| | | | |
|---|---|---|---|
| 888,739 | 5/1908 | Reiber | 220/86 |
| 1,113,453 | 10/1914 | Love | 220/86 R X |
| 2,291,230 | 7/1942 | Johnson | 220/86 R |
| 2,613,013 | 10/1952 | Van Pelt | 220/86 X |
| 2,874,712 | 2/1959 | Eshbaugh | 220/86 X |
| 3,187,935 | 6/1965 | Lense | 220/86 |
| 3,394,842 | 7/1968 | Randolph et al. | 220/86 |
| 3,817,421 | 6/1974 | Andres | 220/86 |
| 4,625,777 | 12/1986 | Schmidt | 220/86 R X |
| 4,653,312 | 3/1987 | Sharp | 73/49.27 |
| 4,714,171 | 12/1987 | Sasaki et al. | 220/86 R |

*Primary Examiner*—Frankie L. Stinson

*Attorney, Agent, or Firm*—Gerry J. Elman; Ash Tankha

[57] ABSTRACT

An underground storage tank for fluids such as gasoline or chemicals is provided with L-shaped piping means for venting vapor pockets that would normally be trapped inside an inclined tank. The tank has a generally cylindrical top surface with one or two vent tubes secured inside the top of that surface, each tube extending from a point immediately adjacent a head wall to an upstand exiting through the manway cover. When a pair of such tubes and upstands is provided, vapor can be vented or discharged to the atmosphere, regardless of which way the tank is inclined. Such venting of trapped vapor prior to a hydrostatic test on an underground storage tank permits accurate determination of tank leakage and integrity. Existing tanks may be retrofitted with such venting means.

12 Claims, 4 Drawing Sheets

510
500
522
542
526
528
520
502
504
506
10
14
20
22
24
25
26
27
28
19
42
40
104
1
1

CYLINDRICAL STORAGE TANK WITH VAPOR PURGING MEANS

FIELD OF THE INVENTION

The present invention relates to an improved underground storage tank, e.g. for hydrocarbon fuels, organics, toxics, and hazardous materials. More particularly it relates to means for venting air, gases or vapors trapped inside such tanks, as well as an improved method of testing for leakage from the tank in which such improved venting means are employed. It also relates to a way to retrofit existing tanks to provide such improvement.

BACKGROUND OF THE INVENTION

To minimize pollution of soil and water, an underground storage tank containing hydrocarbon fuels, organics, toxics, or hazardous materials must be tested periodically for leakage, for the life of the tank, in accordance with regulations of the federal Environmental Protection Agency.

Field testers can ascertain leakage in underground storage tanks by a hydrostatic test. The test typically involves topping off the tank with more of the liquid that is in the tank or another acceptable liquid and then applying pressure to the tank for a certain a period of time. If there is no leakage, the pressure should remain unchanged.

However, if the head space in the tank contains vapor, the leakage test result may be false or inaccurate due to condensation or vaporization, for example due to temperature change while the test is being run. It is therefore necessary to remove such vapor before running such underground tank leakage tests. At present, such vapor is purged by first opening or "cracking" the manhole or other tank nozzle to allow the vapor to be displaced as the tank is filled up with a liquid—a time consuming, expensive and sometimes hazardous procedure.

SUMMARY OF THE INVENTION

Figure 1:
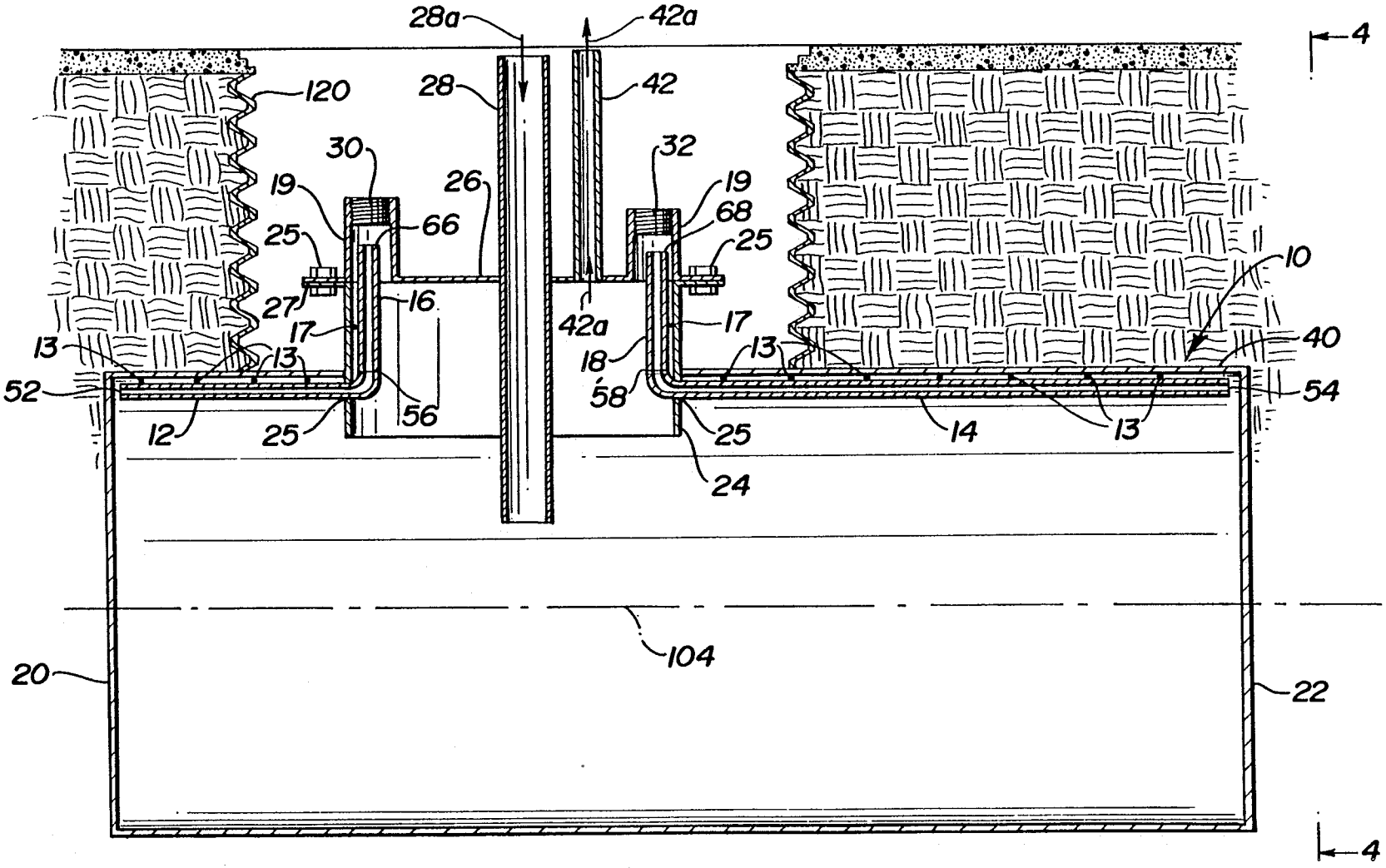
FIG. 1 is an elevational cross-section of an installed underground storage tank incorporating the vapor purging means of the present invention.

It is an object of the present invention to provide a storage tank for liquids having improved means for venting accumulated vapor. I have found that when cylindrical tanks are buried underground, the ground often settles unevenly, with the cylindrical axis of the tank ending up at an angle to the horizontal. A disadvantage of such uneven settling is the formation of a pocket of trapped gases (generally air mixed with vapor from the liquid in the tank). Such gas pockets tend to interfere with leakage tests, as stated above. I have also observed, however, that it is unusual for the tank to rotate about its cylindrical axis.

It is an object of my invention to overcome the disadvantage of such uneven settling and formation of a gas pocket. This is accomplished by providing a way to remove such trapped gases from the tank before performing a test for leakage.

It is a feature of my invention to provide means for venting gases trapped at the higher end of the tank. In accordance with my invention, venting means are provided near the highest point at the juncture of the tank's cylindrical wall and the higher of the tank's two head walls. Since, in most instances, it is not predictable which of the two head walls will end up being the higher one after settling, a preferred embodiment of my invention provides such venting means adjacent each of the two head walls.

Such an improved venting means is incorporated in a tank having three (or more) wall surfaces. The top wall surface is a cylindrical wall, which defines a cylindrical axis that is at an angle within about 45 degrees of horizontal. The other two wall surfaces are a pair of heads. Conventionally in such a tank, a manway neck extends through an opening in the top of the cylindrical wall, and a manway cover is removably secured to the top of the manway neck.

The improved venting means of the present invention comprises an L-shaped pipe, generally comprising a vent tube, and an upstand tube in communication with the vent tube. The mouth of the vent tube is at a point adjacent to the highest point of one of the head walls. The vent tube extends along the top of the cylindrical wall of the tank to communicate with the inlet of an upstand tube. The upstand tube extends upwardly from the inlet through the manway. The discharge port of the upstand is above the top of the manway neck. The position of this venting means takes advantage of my observation that the cylindrical tank generally does not rotate about its cylindrical axis during settling, and so the mouth of a vent tube should be positioned at the top of the cylindrical wall immediately adjacent a head wall.

If the tank is installed in the ground with one end somewhat higher than the other, then a single L-shaped pipe, having a mouth adjacent to the higher of the two head walls, will be sufficient to provide the advantage of the present invention. Furthermore, if an existing tank that lacks the improved venting means is to be retrofitted with such an improved venting means, it may similarly be provided with a single L-shaped pipe to serve the end of the tank which is higher after the completion of settling.

However, a preferred version of the present invention that is usefully incorporated in a tank before it has been installed incorporates a pair of L-shaped pipes, one having a mouth adjacent the first head wall and the other having a mouth adjacent the second head wall. Thus, regardless of whether the tank settles into a position with the first head wall being higher than the second or into a position with the second head wall being higher than the first, one of the two L-shaped pipes will have its mouth in a position suitable to vent any accumulated gases that would otherwise be trapped at the highest point within the tank.

It is an advantage of the present invention that by permitting the elimination of gases trapped in a pocket, the tank may be filled to capacity when desired and appropriate.

As used herein, the term "cylinder" means a three-dimensional shape described by a series of parallel lines which pass perpendicularly through the periphery of a convex two-dimensional shape, and a "cylindrical" wall is a wall which is in the shape of a cylinder. Most commonly, the two-dimensional shape is a closed figure, and such a wall for a tank in accordance with the present invention forms the tank's bottom as well as its top. However, it is also possible for a tank in accordance with the present invention to be formed with a bottom wall which is not cylindrical.

Most commonly the vertical cross-section of a tank in accordance with the present invention is circular, but it may be elliptical or otherwise ovoid, diamond-shaped, or in general any shape known in the art.

The heads of the tank are most often vertical and generally planar, but they may be dished outwards or inwards as is known in the art and need not be perpendicular to the axis of the cylinder.

The present invention provides also an improved method for testing such an underground storage tank for leakage, which comprises the steps of opening a hole in the manway cover, and securing a fill tube to it, unsealing the upstand which projects above the highest point of the tank, infusing a suitable liquid through the fill tube until substantially all the vapor in the tank is displaced by the liquid and thereby vented through the upstand, sealing the upstand, pressurizing the tank with an appropriate fluid, measuring the pressure within the tank, allowing a period of time to elapse, and then measuring the pressure within the tank again. This method provides an accurate result of the leakage test as a result of the effective purging of vapor from the tank.

An existing storage tank may be retrofit with venting means in accordance with the present invention by providing one or more vent tubes and upstands and securing them within the tank. To facilitate fabrication and installation, the vent tubes and upstands may be formed of conventional lengths of pipe joined using conventional pipe couplings.

DESCRIPTION OF PREFERRED EMBODIMENTS OF THE INVENTION

Figures 4, 5:
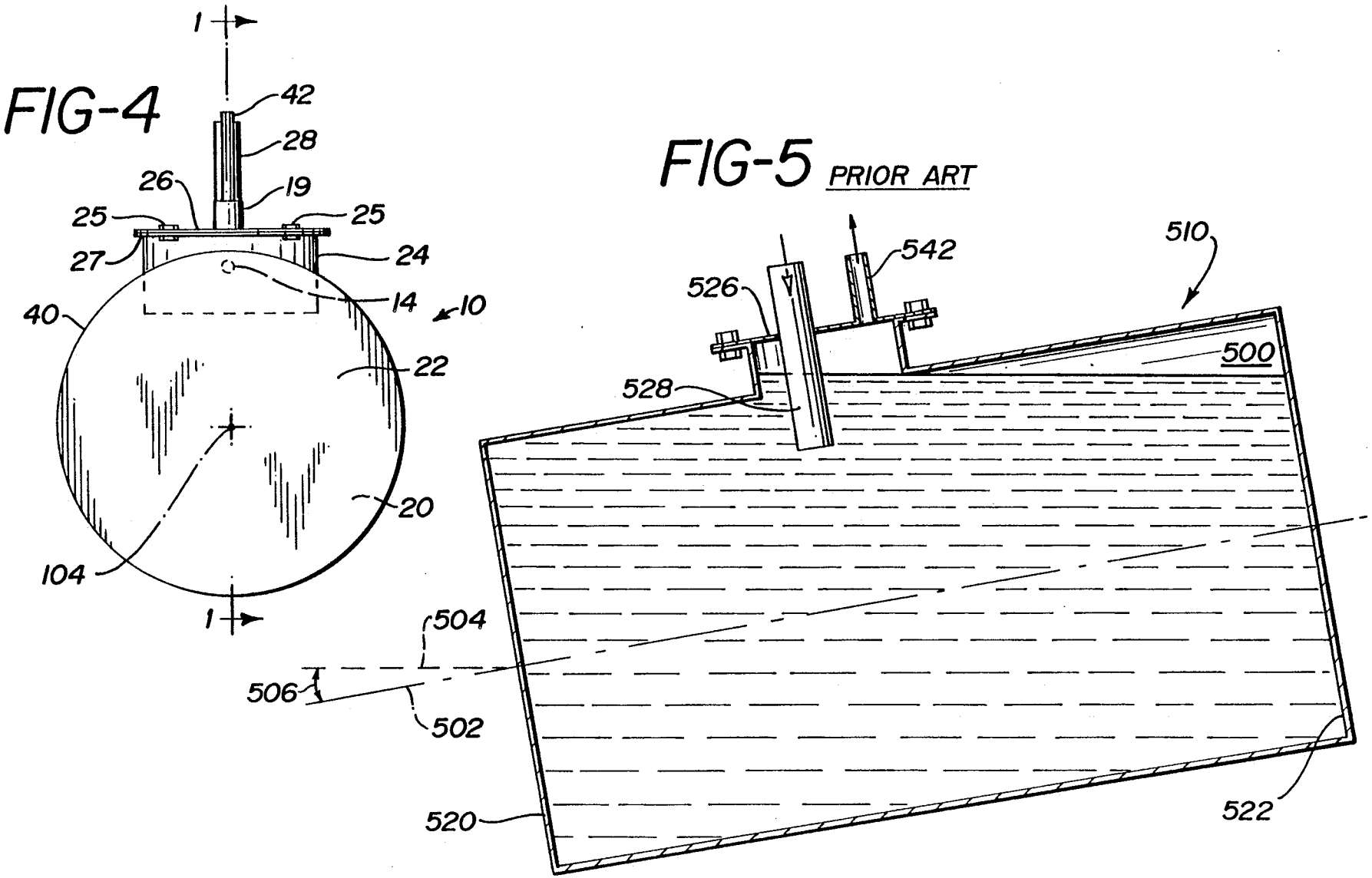
FIG-5 PRIOR ART
FIG. 4 is an elevational view of the tank of FIG. 1, taken from line 4—4 omitting the surroundings of the tank.
FIG. 5 is an elevational cross-section of the nature of FIG. 2, showing a storage tank of the prior art which has settled at an incline to the horizontal, trapping gas in a space 500.

As shown in FIGS. 1 and 4, a typical underground storage tank 10 in accordance with the present invention comprises a cylindrical wall 40 and a pair of head walls 20,22. Extending through the top of the cylindrical wall 40 is a generally cylindrical manway neck 24, conventionally 24" in diameter, but which may be of virtually any convenient dimension, whether or not capable of allowing a person to pass through. A manway cover 26 is sealably secured to the top of manway neck 24 in a detachable manner, conventionally by bolts 25 secured to a flange 27 extending from the manway neck 24. The manway neck 24 extends above and below the junctions of it with cylindrical wall 40 of the tank 10.

An air displacement tube 42 extends upwardly from the manway cover 26, typically when installed terminating just below ground level. The arrows **42*a* show that air may flow out to vent the tank when pressure builds up. Optionally a fill tube 28 also extends through the manway cover 26. The arrow 28*a* shows the direction of fluid flow in filling the tank. Alternately, in the absence of a fill tube 28, a stoppered fill opening (not shown) in the manway cover 26 would provide an opportunity to introduce a tube through the manway cover 26 to infuse liquid into the tank 10**.

Optionally, as shown in FIG. 1, a corrugated liner 120 is installed to prevent soil from piling up around the manway neck 24 and obstructing access to it.

In accordance with the present invention, improved means for venting vapor from the tank comprise a pair of vent tubes 12,14 of thin wall pipe or tubing, typically ¾" inside diameter, which respectively extend from mouths 52,54 into the manway neck 24 through diametrically opposite points of the manway neck 24, make a 90-degree turn upwards, and terminate respectively at junctions 56,58 with mouths of the upstands 16,18. The upstands 16,18 extend from the junctions 56,58 with vent tubes 12,14 to discharge ports 66,68 above the level of the manway cover 26. The upstands 16,18 are attached to the manway neck at welding points 17 or alternatively by clamps or other such fixtures (not shown).

In a preferred embodiment, extending upwards from the level of the manway cover 26 to provide for and surround the upstands 16,18 are pipes 19 removably sealed by blind flanges 30,32 or alternatively by valves (not shown). Alternatively, means for sealing the upstands 16,18 to openings drilled in the manway cover 26 could be provided. In such an alternative embodiment, closures equivalent to the blind flanges 30,32 could be installed at the discharge ports 66,68.

The vent tubes 12,14 are attached to the inner surface of the cylindrical wall 40 along the top of the tank 10, by welding the tubes to the steel inner surface at welding points 13 or alternatively by clamps or other such fixtures (not shown) located at regular intervals, typically 24".

If needed to accommodate the construction of the manway neck 24, holes 25 of appropriate size, typically 1" diameter, in the manway neck 24, permit the vent tubes 12,14 to protrude into the manway. The vent tubes 12,14 may be tack welded at such holes in the manway neck 24.

A small gap is provided between the mouths 52,54 of the vent tubes 12,14 and the head walls 20,22 of the tank to allow for venting of vapor into the vent tubes 12,14.

As shown in FIG. 1, the axis 104 of the cylindrical tank wall 40 is horizontal, as it is installed and intended to remain. However, in the event that the tank settles off center during its anticipated life, as shown for example in FIG. 2, or is installed so that one end of the tank is higher than the other end, as shown for example in FIG. 3, gas (air and vapor) which would otherwise be trapped at the higher end of the tank (for example in spaces denoted by 200,300) can be removed from the tank by pumping liquid into the tank through the fill tube 28 or 328 so as to raise the level of the liquid in the tank to or above the top of the space 200,300 at the higher end of the tank.

Figure 2:
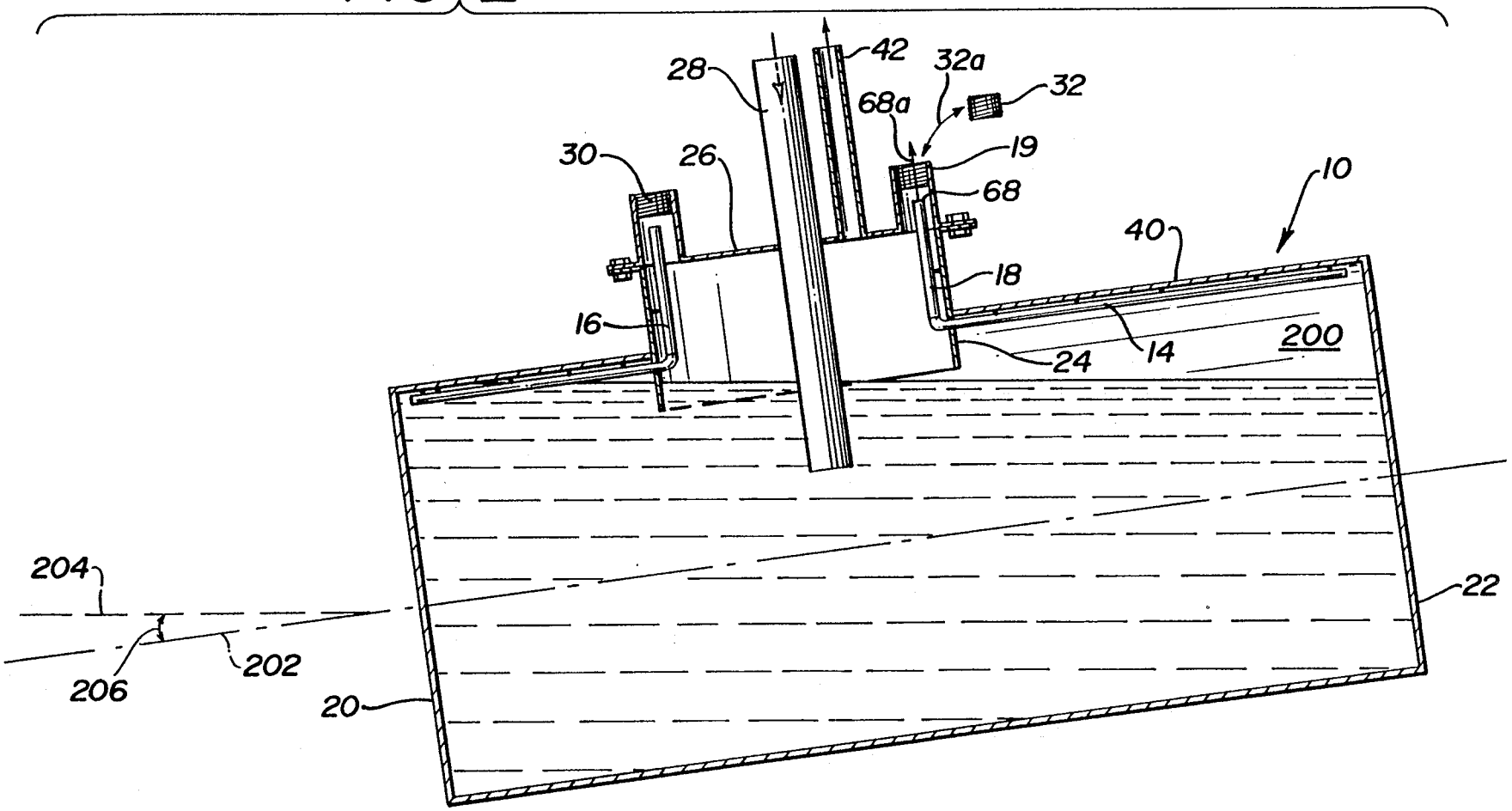
FIG. 2 is an elevational cross-section of an underground storage tank generally as shown in FIG. 1 but omitting the surroundings of the tank, illustrating the functioning of the vapor purging means of the present invention when the partially filled tank has settled at an incline 206 to the horizontal 204.

FIG. 2 illustrates a tank 10 of the present invention which has been buried in ground that has settled unevenly. As shown, the cylindrical axis 202 of the tank 10 is at an angle 206 to the true horizontal 204.

Similarly, FIG. 5 illustrates a conventional tank 510 of the prior art, which does not have vent tubes 12,14 or associated structures of the present invention. As shown, the cylindrical axis 502 of the tank 510 is at an angle 506 to the true horizontal 504. When liquid would be added to the tank 510, the volume of the head of gases (air and vapor) above the liquid would decrease to a minimum but would never become zero. In that circumstance a certain volume of gas would be trapped in vapor space 500 and could not be purged from the tank without at least shifting the axis 502 of the tank. Such shifting would be a virtual impossibility for an installed underground tank.

In accordance with the present invention, however, as shown in FIG. 2, the hydrostatic pressure of the liquid head through the fill tube 28 will force the trapped vapor from space 200 into the vent tube 14 and thence into upstand 18, thereby reducing the volume of the gas space 200 at the higher end of the tank. From the discharge port 68, the vapor can be vented to atmosphere by, as shown, opening (as represented by arrow 32*a*) the blind flange 32 which normally seals the top of the pipe 19 surrounding the top of upstand 18. Alternatively, a valve (not shown) could be substituted for blind flange 32 to facilitate opening and closing the top of pipe 19.

Figure 3:
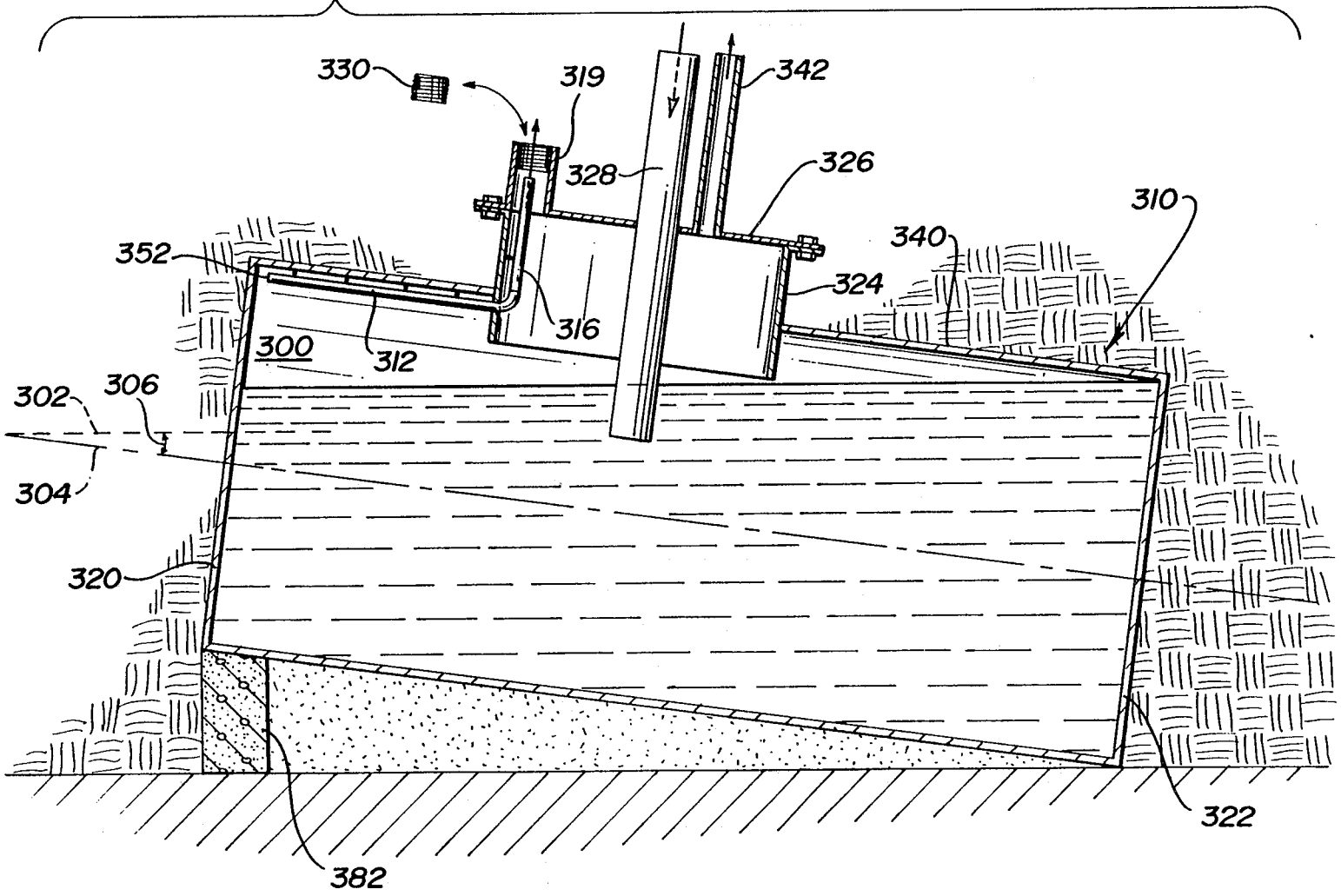
FIG. 3 is an elevational cross-section of an alternative embodiment of the present invention, using only a single vent tube 312 and upstand 316 wherein the tank has been intentionally installed at an incline 306 to the horizontal 304.

FIG. 3 shows a tank 310, wherein a single L-shaped piping means is employed in accordance with the present invention to vent accumulated gases from a space 300. The piping comprises a vent tube 312 having a mouth 352 adjacent the top of the higher of the two head walls 320,322. Here head wall 320 is shown as having been made the higher of the two head walls by intentionally installing the tank so that its axis 304 is at an acute angle 306 to horizontal 302. As shown, simply for illustration to make it clear that the top of head 320 is elevated slightly above the level of the top of head 322, a footing 382 is used to provide such elevation. In such event, venting means adjacent to the other (lower) head wall 322 are not needed and accordingly are not incorporated in the tank 310.

Testing for Leakage

The present invention provides an improved method for testing such an underground storage tank for leakage. With respect to the embodiment illustrated in FIG. 2, for example, such method comprises a first step of unsealing whichever of the upstands 16 or 18 projects above the highest point of the tank 10 (or alternatively unsealing both as by removing blind flanges 30 and 32 from the pipes 19). Next the tester infuses a suitable liquid which is the same as or compatible with the liquid in the tank through the fill tube 28 extending through the manway cover 26 until substantially all the vapor in the tank 10 is displaced by the liquid and thereby vented through the upstand 16 or 18.

When the liquid is visible near the top of the upstand 16 and/or 18, the tester is assured that virtually all vapor or air has been purged from the tank. Next, the upstand 16 or 18 is sealed, e.g. by closing pipe 19 with blind flange 32, as indicated by arrow 32*a*, and then the tank 10 is pressurized with air or another appropriate fluid (e.g. nitrogen). The pressure in the tank 10 is measured, and a suitable period of time is allowed to elapse. Then the pressure within the tank 10 is measured again. This method provides an accurate result of the leakage test as a result of the effective purging of vapor from space 200 within the tank 10.

Retrofitting

Tanks already in the ground, which have settled unevenly may be retrofitted with vapor purging means in accordance with another aspect of the present invention. To do so, a worker would enter an empty conventional tank, such as tank 500, through the manway neck 24 and install at least one vent tube 14 extending to the higher one of the head walls 22 by welding or otherwise securing the vent tube 14 to the top of the inner surface of the steel tank. A new manway cover 26 incorporating a pipe 19 to accommodate an upstand 18 may desirably be installed over the manway neck 24; alternatively the existing manway cover 26 may be drilled for a new upstand 18, which would be provided and inserted through such a hole and sealed thereto. After securing the manway cover 26 over manway neck 24, the vent tube 14 would be sealed in communication with upstand 18.

If the tank had not already settled, or if further settling is anticipated which might result in the other head wall 20 becoming higher than the currently higher head wall 22, then a vent tube 12 and an upstand 16 could similarly be provided and installed.

It is apparent that the objects of the invention are fulfilled by the foregoing disclosure. It is to be understood, however, that many modifications may be made to the basic invention, some of which have been mentioned above. These and other modifications are to be deemed within the spirit and scope of the above-disclosed invention, which should be interpreted with reference to the following claims.

Having thus described the invention, what I desire to protect by Letters Patent and hereby claim is:

1. A storage tank for volatile liquids having improved means for venting accumulated vapor, which comprises:

(a) a tank comprising a shell that is capable of being hydrostatically pressurized, the shell having a generally cylindrical top wall defining a cylindrical axis that is initially within about 45 degrees of the horizontal, a pair of head walls, one of them being higher than the other, a manway neck extending perpendicular to the cylindrical axis through an opening in the top wall, and a manway cover secured in sealing relationship at the top of the manway neck, and (b) means for venting the gases accumulated adjacent to the top wall and the higher of the two head walls, comprising L-shaped piping having an arm generally parallel to the cylindrical axis, said piping extending from a mouth immediately adjacent to the highest point of intersection of the cylindrical top wall and the higher of the head walls to a discharge port above the level of the manway cover; whereby the gases accumulated as aforesaid may be purged from the tank through the discharge port, and further comprising means for closing said discharge port.

2. The storage tank of claim 1, wherein said L-shaped piping has a generally horizontal leg extending from the mouth and a generally vertical leg terminating at the discharge port, and the generally horizontal leg of the piping is secured to the inner surface of said top wall.

3. The storage tank of claim 2, wherein said generally vertical leg of the piping extends upwardly through said manway.

4. The storage tank of claim 3, wherein said manway cover includes a closable pipe extending upwardly from and sealed to an opening in said manway cover to accommodate therewithin the discharge port of said L-shaped piping.

5. The storage tank of claim 1, wherein said manway cover includes a closable pipe extending upwardly from and sealed to an opening in said manway cover to accommodate therewithin the discharge port of said L-shaped piping.

6. The storage tank of claim 5, wherein said closable pipe has a removable closure at the top thereof comprising a blind flange.

7. A storage tank for volatile liquids having improved means for venting accumulated vapor, which comprises:

(a) a tank comprising a shell that is capable of being hydrostatically pressurized, the shell having a generally cylindrical top wall defining a cylindrical axis that is within about 45 degrees of the horizontal, a pair of head walls, a manway neck extending perpendicular to the cylindrical axis through an opening in the top wall, and a manway cover secured in sealing relationship at the top of the manway neck, and (b) means for venting the gases accumulated adjacent to the top wall and either of the two head walls, comprising a pair of vent tubes and upstands, each of said vent tubes extending generally parallel to the cylindrical axis, from a mouth immediately adjacent to the highest point of intersection of the cylindrical top wall and a respective head wall to a coupling with the mouth of a respective upstand tube, each of said upstand tubes extending from such coupling with said vent tube upwardly to a discharge port above the level of the manway cover and further comprising means for sealing closed said discharge port.

8. The storage tank of claim 7, wherein each of said vent tubes extends along a line within the tank that is parallel to the cylindrical axis and is secured below the highest generally straight line in the surface of said top wall.

9. The storage tank of claim 8, wherein the vent tubes are secured to the inner surface of said top wall by welding.

10. The storage tank of claim 7, wherein each of said upstand tubes extends upwardly through said manway and said manway cover includes a closable pipe extending upwardly from and sealed to an opening in said manway cover to accommodate therewithin the discharge ports of said upstand tubes.

11. The storage tank of claim 7, wherein each of said upstand tubes extends upwardly through said manway and said manway cover includes a pair of closable pipes, each extending upwardly from and sealed to an opening in said manway cover to accommodate therewithin the discharge port of one of said upstand tubes.

12. The storage tank of claim 11, wherein each of said vent tubes extends along a line within the tank that is parallel to the cylindrical axis and is secured below the highest generally straight line in the surface of said top wall.

* * * * *